US006662737B2

(12) United States Patent
Marcangelo et al.

(10) Patent No.: US 6,662,737 B2
(45) Date of Patent: Dec. 16, 2003

(54) MATTRESS LABEL SEWING CLAMP

(75) Inventors: Steven Marcangelo, No. Chelmsford, MA (US); Robert T. Norton, Tewksbury, MA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/147,638

(22) Filed: May 17, 2002

(65) Prior Publication Data

US 2003/0213418 A1 Nov. 20, 2003

(51) Int. Cl.[7] ..... D05B 11/00; D05B 35/06
(52) U.S. Cl. ..... 112/475.01; 112/2.1; 112/475.08
(58) Field of Search ..... 112/470.14, 114, 112/117, 119, 2.1, 104, 115, 152, 311, 475.01; 38/102.91, 102.2; 269/47, 86, 89, 104

(56) References Cited

U.S. PATENT DOCUMENTS 3,044,426 A * 7/1962 Schwarzberger ..... 112/117
3,414,994 A * 12/1968 Jaccard et al. ..... 38/102.91
3,482,536 A 12/1969 Hoever
3,724,836 A 4/1973 Sendoykas et al.
4,467,736 A 8/1984 Perlino
5,520,129 A 5/1996 Porter et al.
5,581,918 A * 12/1996 Schilling et al. ..... 38/102.1
5,595,375 A 1/1997 Bennhausen
5,927,221 A 7/1999 Porter et al.
6,065,412 A 5/2000 Schwarzberger et al.
6,123,042 A * 9/2000 Visi ..... 112/470.16

* cited by examiner

*Primary Examiner*—Ismael Izaguirre
(74) *Attorney, Agent, or Firm*—Wood, Herron & Evans, L.L.P.

(57) ABSTRACT

A clamping system for a sewing machine used to sew first and second materials together. The clamping system has a plurality of clamps mounted adjacent an opening in a frame. Each of the clamps has a stationary member, a movable member and an actuator. The actuator is connected to the movable member and operates to move the movable member in a clamping relationship with the stationary member to clamp the first material in the clamp. The clamp is powered by a cylinder with a linear stroke, and the clamp has a driving member that transfers the linear motion of the cylinder into a pivoting motion of the movable member. Further, the movable and fixed members have forward ends shaped so that they hold the first material but do not interfere with a sewing of the first member to the second member.

19 Claims, 2 Drawing Sheets

MATTRESS LABEL SEWING CLAMP

FIELD OF THE INVENTION

This invention relates generally to sewing machines and more particularly, to a method and apparatus for holding a mattress label while it is being sewn to a mattress panel.

BACKGROUND OF THE INVENTION

Manufacturers are particularly concerned that high quality products portray a high quality image. To this end, identifying labels are preferably made of a high quality material and attached to the product in a high quality manner. In the mattress field, mattress companies have specifications regarding the appearance and the attachment of the label. Among these is the requirement that the outer edge of the label must be securely sewn to a top panel of the mattress. In addition, the label should not have trim tails or other unsightly features.

Label sewing machines are known. One such machine is disclosed in U.S. Pat. No. 5,520,129 entitled "Method and Apparatus for Join and Sew Application". With such a machine a mattress label is placed in a frame and held therein by pins or tacks located at each corner of the frame. While the tacks function well to hold the label, it requires mental focus and manual dexterity to manipulate each small corner of the label such that it is properly secured to a respective tack. When performed repeatedly over periods of time, such an operation can be stressful and prone to error. In addition, a corner of the label may accidently come off of its respective tack. Whether from an improper loading of the label or an accidental release of a label corner, a loose label corner often results in the label not being properly sewn on the mattress. Manually removing and/or resewing the label on the mattress panel is labor intensive and expensive.

Therefore, there is a need for a better way to more reliably secure the mattress label while it is being sewn on a mattress panel.

SUMMARY OF THE INVENTION

The present invention provides a clamping system for a sewing machine that reliably secures the mattress label while it is being sewn on a mattress panel. The clamping system of the present invention is easier to use and therefore, leads to a faster and more reliable placement of the mattress label in the sewing machine. Thus, the clamping system of the present invention is especially useful in a production environment where its ease of use and reliability help to substantially relieve sewing machine operator stress in the process of sewing a label to a product. Further, the clamping system of the present invention substantially reduces rework or resewing of a label and therefore, provides a more efficient and cost effective label sewing operation.

According to the principles of the present invention and in accordance with the described embodiments, the invention provides a clamping system for a sewing machine. The sewing machine has a frame and an opening in the frame for receiving a first material that is to be sewn with the sewing machine to a second material. The clamping system has a plurality of clamps mounted adjacent the opening in the frame. Each of the clamps has a stationary member, a movable member and an actuator. The actuator is connected to the movable member and operates to move the movable member in a clamping relationship with the stationary member to clamp the first material in the clamp.

In one aspect of the invention, the clamp is powered by a cylinder with a linear stroke, the clamp has a driving member that transfers the linear motion of the cylinder into a pivoting motion of the movable member. Further, the movable and fixed members have forward ends shaped so that they hold the first material but do not interfere with a sewing of the first material to the second material.

In another embodiment of the invention, a method of securing a stitchable material in a sewing machine having a frame and an opening in the frame for receiving the stitchable material. First, an edge of the stitchable material is located between a movable member and a fixed member of a clamp mounted adjacent the opening. Next, the movable member is moved toward the stationary member to clamp the edge of the stitchable material between the movable and the stationary members. In one aspect of this invention, a driving member is translated by an actuator and raises a rearward end of the movable member, thereby pivoting a forward end of the movable member against a forward end of the stationary member.

These and other objects and advantages of the present invention will become more readily apparent during the following detailed description taken in conjunction with the drawings herein.

DETAILED DESCRIPTION OF THE INVENTION

Figure 1:
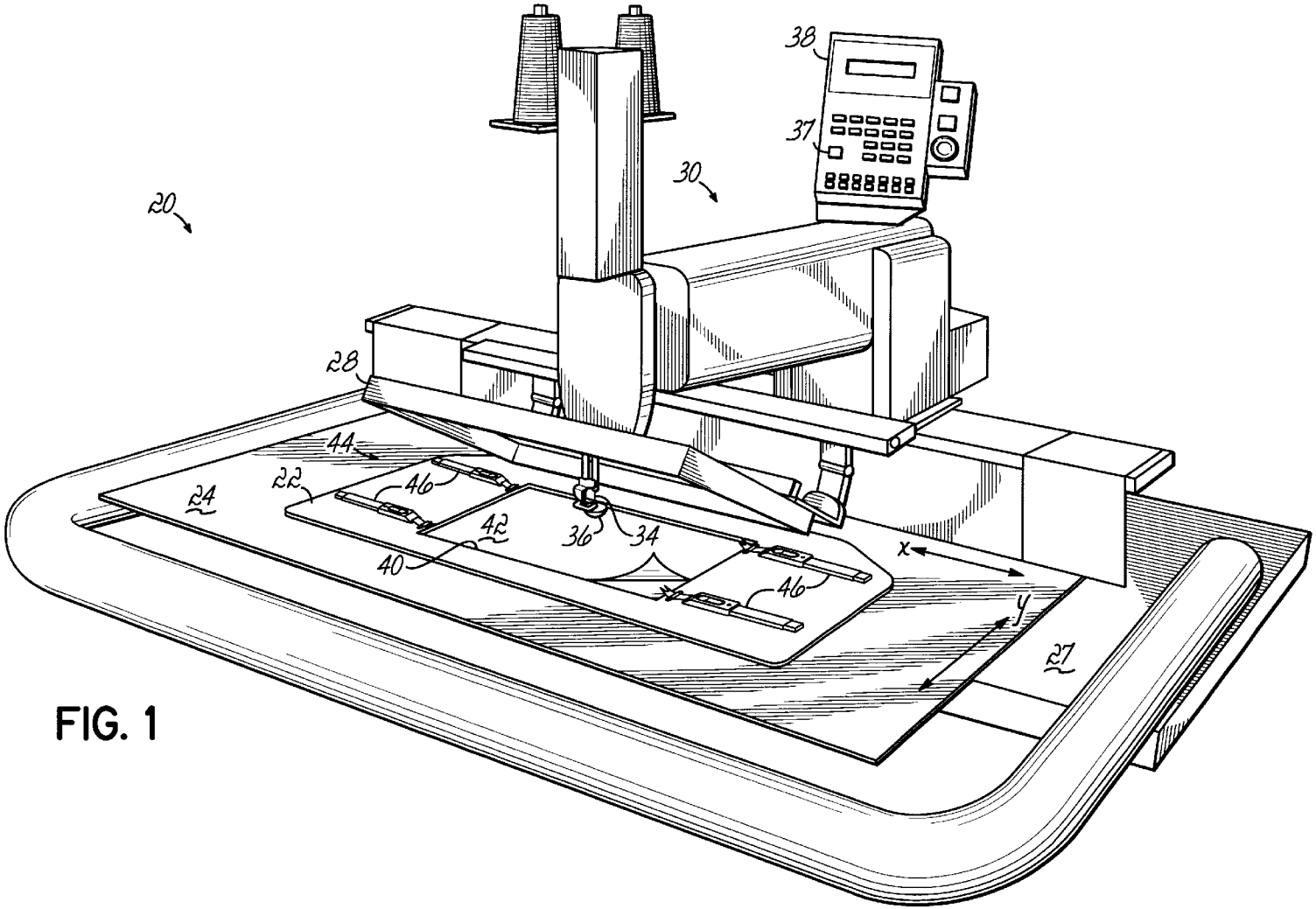
FIG. 1 is a schematic perspective view of a mattress label sewing system utilizing a clamping system in accordance with the principles of the present invention.

Referring to FIG. 1, a sewing system 20 includes a frame 22 mounted on a base plate 24. The base plate 24 and a pivotable panel clamp 28 are movable in mutually perpendicular X and Y directions with respect to a base 27 in a known manner. A sewing machine 30 has a needle 34, a presser foot 36, a bobbin (not shown) and actuators (not shown) for moving the base plate 24 and panel clamp 28 in response to command signals from a sewing machine controller 38 in a known manner.

The sewing machine 30 is an electronically programmable X-Y sewing machine that, in one embodiment, utilizes a Mitsubishi No. PLK A 4516 sewing machine. The sewing machine 30 performs lock-stitching and may be programmed to implement different styles of lock-stitching, for example, a zig-zag stitch of 7.5 millimeters. Lock-stitching is a known technique of interlacing a needle thread and bobbin thread, which will not be described here further except to indicate that a needle thread is carried by needle 34 and a bobbin thread provided by a bobbin (not shown).

The operation of the sewing machine 30 is controlled by user operating I/O devices 37 on a front panel of the controller 38. During execution of a control program, the controller 38 receives inputs from devices, for example, a main shaft encoder, and provides command signals to a sewing head motor (not shown) and actuators (not shown) to implement a stitch pattern in a known manner. The controller 38 also provides command signals to perform other operations, for example, raise and lower the presser foot 36, raise and lower the panel clamp 28, etc. In those operations, the command signals are received by solenoids (not shown) that, in turn, change the states of pneumatic logic, which supply pressurized air to various pneumatic components in a known manner. The air cylinders and other pneumatic devices are commercially available from various suppliers, for example, Bimba Manufacturing Company of Monee, Ill. The structure and operation of a sewing machine similar to the sewing machine described herein is fully described in U.S. Pat. No. 5,520,129 entitled "Method and Apparatus for Join and Sew Application", which application is hereby incorporated by reference in its entirety herein.

The sewing machine 30 is illustrated with the panel clamp 28 in its raised position. The label frame 22 and base plate 24 have respective openings 40 in which a mattress label 42 can be located. A label clamping system 44 is used to hold the mattress label 42 within the opening 40. The label clamping system 44 is comprised of four clamps 46 mounted on the label frame 22. Each of the clamps is identical in its structure and operation.

Figure 2:
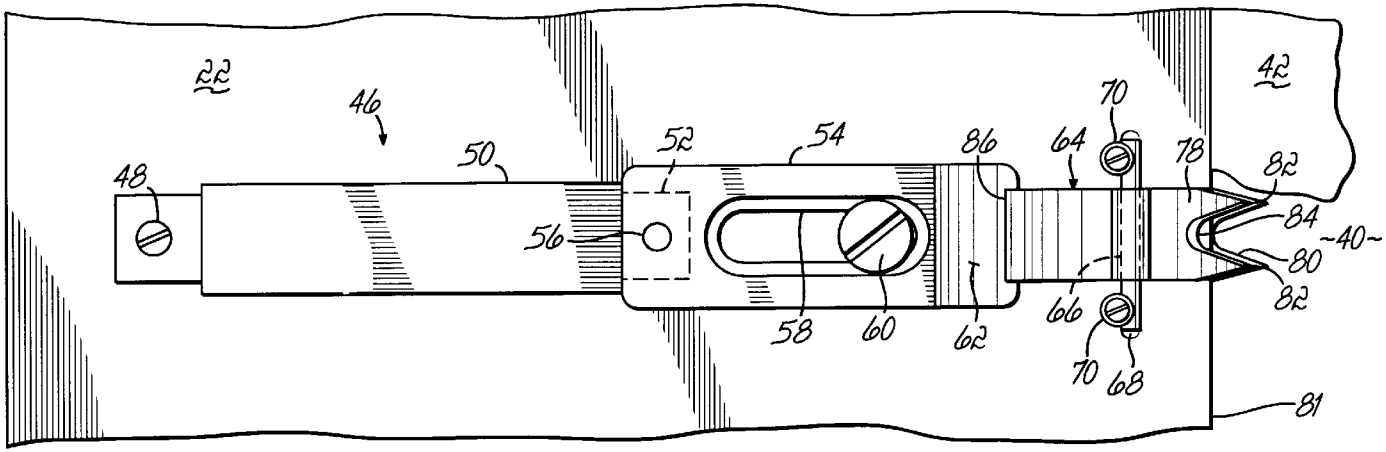
FIG. 2 is top plan view of one of the clamps of the clamping system illustrated in FIG. 1.

Referring to FIG. 2, a clamp 46 has an actuator 50, for example, a pneumatic cylinder, mounted to an upper side of the frame 22 by fasteners 48 or other means. The actuator 50 has an actuator shaft or rod 52, for example, a cylinder rod, extending from a forward end. The actuator rod 52 extends and retracts or translates through a linear motion in response to the actuator 50 being operated between its two states. The actuator rod 52 is connected to a rearward end of a toggle driver 54 by a pin or other fastener 56. The toggle driver 54 has a slot 58 that receives a guide pin 60, for example, a screw or other fastener. The slot 58 and guide pin 60 function with the actuator rod 52 to facilitate a translation or linear motion of the toggle driver 54.

Figure 3:
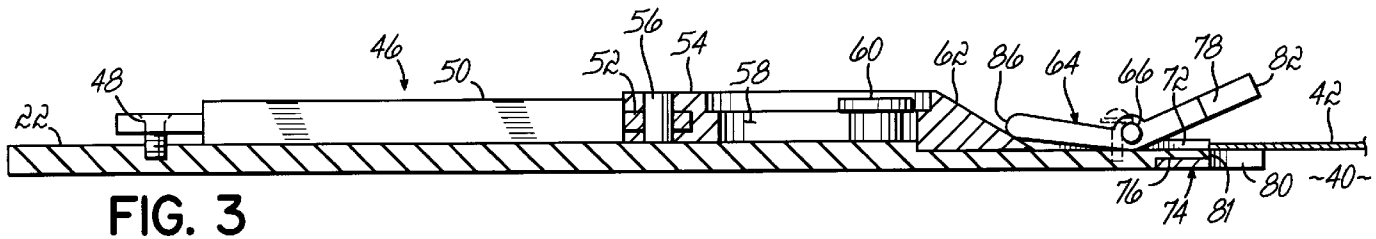
FIG. 3 is side view in partial cross-section of the clamp of FIG. 2 illustrating the clamp in an open position.

A movable pivot clip or member 64 is pivotally mounted on the frame 22 with a pivot pin 66 that is located in a groove 68 and secured by pin clamps 70. As shown in FIG. 3, the pivot clip 64 is mounted in a slot 72 located in an upper surface of the frame 22. A fixed or stationary clip 74 is mounted by fasteners (not shown) in a slot 76 located in a lower surface of the label frame 22. The forward end 78 of the movable clip 64 and the forward end 80 of the fixed clip 74 extend over an opening edge 81 and into the opening 40 in the label frame 22. The forward ends 78, 80 of the respective clips 64, 74 have a shape that is effective to secure the label 42 therebetween but does not interfere with the sewing machine sewing around a perimeter of the label 42. As shown in FIG. 2, the forward ends 78, 80 of each of the respective clips 64, 74 terminate with a pair of small pointed tips 82 that are separated by a V-shaped cutout 84.

Figure 4:
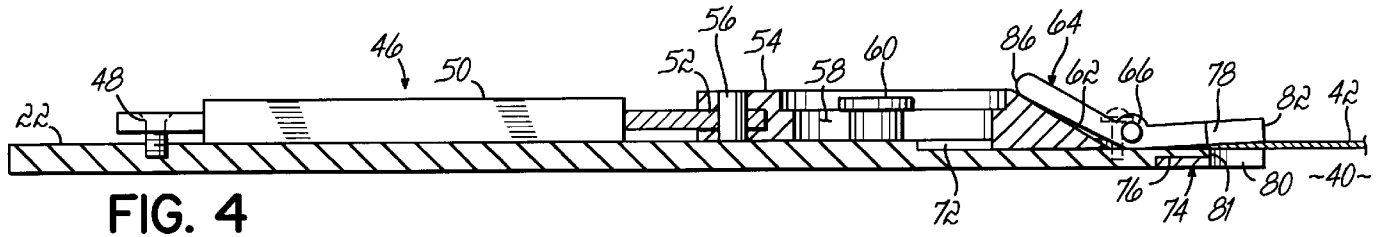
FIG. 4 is side view in partial cross-section of the clamp of FIG. 2 illustrating the clamp in a closed position.

Referring to FIG. 3, the forward end of the toggle driver 54 has an angled or inclined surface 62 that receives a rearward end 86 of the pivot clip 64. When the actuator 50 is in a first state in which the actuator rod 52 is fully retracted, the rearward end 86 of the pivot clip 64 is located at a lower end of the inclined surface 62, thereby placing the forward end 78 of the pivot clip 64 in a raised position. A user generated command signal from the controller 38 changes a state of an actuator solenoid (not shown) that, in turn, changes a flow of pressurized air to the actuator 50, thereby changing its state. Changing the state of the actuator 50 extends the actuator rod 52 and moves the toggle driver 54 forward, that is, from left to right as viewed in FIG. 3. As the inclined surface 62 is moved forward, the rearward end 86 of the pivot clip 64 moves up the inclined surface 62, thereby pivoting the pivot clip 64 clockwise as viewed in FIG. 3 about the pivot pin 66. Raising the rearward end 86 of the pivot clip 64 simultaneously lowers its forward end 78. Referring to FIG. 4, when the actuator rod 52 is fully extended, the pivot clip forward end 78 is closed against the forward end 80 of the stationary clip 74, thereby closing the clamp 46 and securing the label 42 therein.

When the command signal from the controller 38 again changes state, it changes the state of the actuator solenoid that, in turn, changes a flow of pressurized air to return the actuator 50 to its original state. In that process, actuator rod 52 is retracted; and the toggle driver 54 moves rearward, that is, from right to left as viewed in FIG. 4. As will subsequently be described, the pivot clip 64 is pivoted counterclockwise as viewed in FIG. 3 and its rearward end 86 moves down the inclined surface 62. The lowering of the rearward end 86 of the pivot clip 64 simultaneously raises its forward end 78, thereby opening the clamp 46 as shown in FIG. 3. The pivot clip rearward end 86 is made to be heavier than the forward end 78, and therefore, the pivot clip rearward end 86 tends to drop down.

In use, referring to FIG. 1, a user operates appropriate I/O devices 37 on the controller 38 to move the base plate 24 to a desired starting location and then to raise panel clamp 28 in a known manner. Thereafter, the user disposes a label 42 face-side down in the opening 40 and locates edges of the label 42 on the forward ends 80 (FIG. 3) of respective stationary clips 74. When the label edges are located on the stationary clips 74 to the user's satisfaction, the user operates appropriate I/O devices 37 on the controller 38 to command a change of state of all of the actuators 50 (FIG. 3) of all respective clamps 46. The actuators 50 simultaneously extend respective actuator rods 52 and move respective toggle drivers 54 forward. The forward motion of the respective toggle drivers 54 lowers respective pivot clip forward ends 78 against respective stationary clip forward ends 80. That process simultaneously closes all of the clamps 46 and clamps edges of the label 42 between the pivot clip forward ends 78 and respective stationary clip forward ends 80. As will be appreciated, after the clamps 46 have been closed, the user can operate appropriate I/O devices 37 on the controller 38 to command the clamps 46 to open, so that edges of the label 42 can be repositioned. The clamps 46 are then closed again as described above.

After the label 42 is properly positioned within the opening 40, the user then places a mattress panel (not shown) over the clamped label 42. The user again activates appropriate I/O devices 37 on the controller 38 to lower the panel clamp 28. The panel clamp 28 secures the mattress panel against the frame 22 in a desired position relative to the clamped label 42 in a known manner. The user then operates the sewing machine 30 so that the label is sewn to the mattress panel with a lock-stitch along an edge of the label. The pointed profiles of the forward ends 78, 80 of the respective pivot and stationary clips 64, 74 permit the label edge to be satisfactorily secured and also allow a zig-zag stitch or the like to proceed down a label edge without interference from the clamps 46.

After the sewing operation is complete, the user again operates appropriate I/O devices 37 on the controller 38 to raise the panel clamp 28. Next, the user operates appropriate I/O devices 37 to command a change of state of all of the actuators 50 (FIG. 3) of the respective clamps 46. The actuators 50 simultaneously retract respective actuator rods 52 and move respective toggle drivers 54 rearward. However, after the sewing operation, the mattress panel is resting on top of the forward ends 78 of the pivot clips 64; and therefore, the rearward ends 86 remain elevated after the respective toggle drivers 54 have been retracted. The user then lifts the mattress panel and sewn label off of the sewing apparatus 20. The mattress label 42 is between the pivot clips 64 and respective stationary clips 74; and as the mattress label 42 is raised from the frame 22, it raises the forward ends 78 of respective pivot clips 64. Thus, the rearward ends 86 of the respective pivot clips 64 drop down onto lower ends of respective inclined surfaces 62, and all of the clamps 46 are open ready to receive another mattress label.

The above-described clamping system 44 reliably secures a label while it is being sewn to a mattress panel. The clamping system 44 is easy to use and therefore, leads to a faster and more reliable placement of the mattress label in the label frame 22 of the sewing machine 30. Thus, the clamping system 44 is especially useful in a production environment where its ease of use and reliability help to substantially relieve sewing machine operator stress in the process of sewing a label 42 to a product. Further, the clamping system 44 substantially reduces rework or resewing of a label and therefore, provides a more efficient and cost effective label sewing operation.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, in the described embodiment of FIG. 2, four clamps 46 are mounted as two opposed pairs of clamps on opposite lateral sides of the frame 22. As will be appreciated, in other embodiments, the clamps 46 may be arranged in other configurations around the perimeter of the frame 22, for example, one clamp can be mounted on each of the four sides of the frame 22 or the two pairs of clamps may be mounted on opposed upper and lower sides of the frame 22.

In the described embodiment, the sewing system 20 is used to sew a label onto a mattress panel, however, as will be appreciated, the sewing system 20 can be used to sew other stitchable materials, for example, leather, a "KEVLAR" composite material, etc. Therefore, in other embodiments, the number of clamps 46 used can be changed to meet the needs of a particular application, for example, depending on the stiffness of the materials being sewn, a greater number or a fewer number of clamps 46 may be used. Further, in the described embodiment, the clamp actuator 50 is described as being pneumatically operated; however as will be appreciated, in other embodiments, the clamp actuator 50 may be electrically operated.

In the described embodiment, the pivot clip 64 is opened by the act of the sewn mattress panel and label being removed from the sewing system 20. However, as will be appreciated, in alternative embodiments, a positive opening force can also be applied to the pivot member 64, for example, a torsion spring can be mounted over the pivot pin 66 and used to apply a biasing force to help move the pivot clip rearward end 86 down the inclined surface 62. In still other embodiments the toggle driver 54 can be replaced by other mechanisms for operatively connecting the actuator 46 to the pivot clip 64.

Therefore, the invention in its broadest aspects is not limited to the specific details shown and described. Consequently, departures may be made from the details described herein without departing from the spirit and scope of the claims which follow.

What is claimed is:

1. A clamping system for a sewing machine having a frame and an opening in the frame for receiving a first material to be sewn with the sewing machine to a second material, the clamping system comprising:

a plurality of clamps mounted adjacent the opening in the frame, each of the clamps comprising a stationary member having a forward end with a pointed tip extending into the opening, a movable member having a forward end with a pointed tip extending into the opening adjacent the pointed tip of the stationary member, and an actuator connected to the movable member and operable to move the pointed tip of the movable member in a clamping relationship with the pointed tip of the stationary member and adapted to clamp the first material therebetween.

2. The clamping system of claim 1 further comprising a driving member connected between the actuator and the movable member for transferring actuator motion to the movable member.

3. The clamping system of claim 2 wherein the driving member pivots the movable member in response to a linear motion of the actuator rod.

4. The clamping system of claim 3 wherein the movable member is pivotally mounted on the frame and has a rearward end and a forward end, the forward end of the movable member extends over an edge of the opening and into the opening.

5. The clamping system of claim 3 wherein the stationary member has a forward end extending over an edge of the opening and into the opening.

6. The clamping system of claim 4 wherein the actuator has an actuator rod and the driving member has a rearward end connected to the actuator rod and an inclined forward end receiving the rearward end of the movable member.

7. The clamping system of claim 6 wherein the actuator rod is extendable and moves the driving member forward to pivot the movable member clockwise toward the stationary member to close the clamp.

8. The clamping system of claim 7 wherein the actuator rod is retractable and moves the driving member rearward to pivot the movable member counterclockwise away from the stationary member to open the clamp.

9. The clamping system of claim 1 wherein each of the forward ends of the movable and the stationary members further comprise a pair of substantially pointed tips separated by a V-shaped cutout extending into the opening.

10. A sewing machine for sewing first and second materials together comprising:

a base;

a base plate movably mounted with respect to the base and having a base plate opening therethrough;

a frame having a frame opening, the frame being mounted on the base plate with the frame opening over the base plate opening, the frame opening adapted to receive the first material therein;

a plurality of clamps, each of the plurality of clamps comprising a stationary member, a movable member, and an actuator connected to the movable member and operable to move the movable member in a clamping relationship with the stationary member, the movable and stationary members adapted to clamp the first material in the frame opening;

a panel clamp movably mounted with respect to the base and adapted to clamp the second material over the first material;

a sewing machine for sewing the first and the second materials together; and a controller for controlling an operation of the sewing machine.

11. A method of securing a stitchable material in a sewing machine having a frame and an opening in the frame for receiving the stitchable material, the method comprising:

locating an edge of the stitchable material between a pointed tip of a forward end of a movable member extending into the opening and a pointed tip of a forward end of a fixed member extending into the opening opposite the pointed tip of the movable member, the movable member and the fixed member forming o a clamp mounted adjacent the opening; and moving the pointed tip of the movable member toward the pointed tip of the stationary member to clamp the edge of the stitchable material therebetween.

12. The method of claim 11 further comprising transferring a linear motion of an actuator into a pivoting motion of the movable member.

13. The method of claim 12 further comprising raising a rearward end of the movable member and simultaneously lowering a forward end of the movable member toward a forward end of the stationary member to clamp the stitchable material between the forward ends of the movable and stationary members.

14. The method of claim 11 further comprising:

translating a driving member forward with the actuator; and raising the rearward end of the movable member with an angled surface of a forward end of the driving member to simultaneously lower the forward end of the movable member and close the clamp on the stitchable material.

15. The method of claim 14 further comprising lowering a rearward end of the movable member and simultaneously raising a forward end of the movable member away from a forward end of the stationary member to release the stitchable material between the forward ends of the movable and stationary members.

16. The method of claim 15 further comprising:

translating a driving member rearward with the actuator; and lowering the rearward end of the movable member with the angled surface of a forward end of the driving member to simultaneously raise the forward end of the movable member.

17. A method of sewing a first material to a second material in a sewing machine having a frame and an opening in the frame for receiving the first material, the method comprising:

locating an edge of the first material in the opening between a movable member and a fixed member of a clamp mounted adjacent the opening;

moving the movable member toward the stationary member to clamp the edge of the first material between the movable and the stationary members;

locating the second material over the first material to orient the first material at a desired position with respect to the second material;

securing the second material against the frame with a panel clamp; and sewing the first and the second materials together.

18. The method of claim 17 further comprising:

releasing the second material from the frame by releasing the panel clamp; and moving the movable member away from the stationary member to unclamp the edge of the first material from between the movable and the stationary members.

19. A clamping system for a sewing machine having a frame and an opening in the frame for receiving a first material to be sewn with the sewing machine to a second material, the clamping system comprising:

a plurality of clamps mounted adjacent the opening in the frame, each of the clamps comprising a stationary member having a forward end extending into the opening and a rearward end mounted on the frame, a movable member having a forward end extending into the opening opposite the forward end of the stationary member and a rearward end, an actuator mounted on the frame and having a reciprocable actuator rod with a distal end, a driving member having a rearward end connected to the distal end of the actuator rod and an inclined planar surface on a forward end, the inclined planar surface receiving the rearward end of the movable member, the actuator being operable to translate the actuator rod and the driving member forward and pivot the forward end of the movable member toward the forward end of the stationary member, thereby clamping the first material therebetween.

* * * * *